United States Patent [19]

Becht

[11] Patent Number: 4,671,443

[45] Date of Patent: Jun. 9, 1987

[54] REPLACEABLE MAGAZINE SYSTEM FOR A FASTENER DRIVING TOOL

[75] Inventor: Carl T. Becht, Cincinnati, Ohio

[73] Assignee: Sencorp, Cincinnati, Ohio

[21] Appl. No.: 867,616

[22] Filed: May 27, 1986

Related U.S. Application Data

[63] Continuation of Ser. No. 627,396, Jul. 3, 1984, abandoned.

[51] Int. Cl.[4] ..... B25F 1/02; B25F 3/00; B25C 5/00

[52] U.S. Cl. ..... 227/109; 227/120

[58] Field of Search ..... 227/109, 114, 116, 120, 227/130–132

[56] References Cited

U.S. PATENT DOCUMENTS

| | | | |
|---|---|---|---|
| 2,857,596 | 10/1958 | Allen et al. | 227/123 |
| 3,042,924 | 7/1962 | Frostad | 227/120 |
| 3,266,698 | 8/1966 | Dickson | 227/120 |
| 3,347,439 | 10/1967 | Doherty | 227/109 |
| 3,347,440 | 10/1967 | Doherty | 227/131 |
| 3,347,441 | 10/1967 | Doherty | 227/131 |
| 3,366,302 | 1/1968 | Blicharski | 227/131 |
| 3,407,709 | 10/1968 | Bade | 227/130 X |
| 3,469,122 | 9/1969 | Doherty | 227/131 X |
| 3,482,754 | 12/1969 | Doherty | 227/131 |
| 3,589,588 | 6/1971 | Vasku | 227/132 |
| 3,602,419 | 8/1971 | Doberne et al. | 227/147 |
| 3,840,165 | 10/1974 | Howard | 227/123 X |
| 4,184,620 | 1/1980 | Ewig | 227/132 X |
| 4,511,074 | 4/1985 | Kille et al. | 227/120 X |
| 4,566,211 | 1/1986 | Becht | 227/109 |
| 4,625,903 | 12/1986 | Becht | 227/131 |

FOREIGN PATENT DOCUMENTS

| | | | |
|---|---|---|---|
| 1209622 | 4/1960 | France | 227/130 |

*Primary Examiner*—Howard N. Goldberg
*Assistant Examiner*—Taylor J. Ross
*Attorney, Agent, or Firm*—Frost & Jacobs

[57] ABSTRACT

A manually attachable and detachable, interchangeable magazine system for use with fastener driving tools of the type having a housing containing a driver operating mechanism for driving a fastener by multiple blows and of the type having a housing containing a driver operating mechanism for driving a fastener by a single blow. Each magazine contains a plurality of fasteners and a driver therefor. Each magazine is removably affixable by hand to one of the tool housing and a carrier within the tool housing. In the instance of a multiple-blow tool, the magazine is shiftable with respect to the tool housing between a normal extended position and a retracted position within the housing. In the instance of a single-blow tool, the magazine is fixed with respect to the tool housing. Each magazine can be a refillable and reusable magazine, or a single-use, disposable magazine. Magazines containing different types of fasteners are interchangeable within the system.

19 Claims, 13 Drawing Figures

REPLACEABLE MAGAZINE SYSTEM FOR A FASTENER DRIVING TOOL

This is a continuation of application Ser. No. 06/627,396, filed July 3, 1984, now abandoned.

TECHNICAL FIELD

The invention relates to a magazine system for fastener driving tools, and more particularly to such a magazine system wherein the magazines are attachable and detachable manually with respect to the fastener driving tool; magazines containing different types of fasteners are interchangeable with respect to the fastener driving tool; and the magazines may be single-use, disposable magazines or multiple-use, refillable magazines.

BACKGROUND ART

Prior art workers have devised many types of fastener driving tools. As used herein and in the claims, the term "fastener" is to be considered in the broadest sense, referring to substantially any fastener capable of being driven into a workpiece. Examples of such fasteners are headed nails, headless nails, staples and clamp nails (of the general type taught, for example, in U.S. Pat. No. 4,058,047).

Perhaps the most common form of fastener driving tool is a pneumatically actuated tool. Prior art workers have developed a multiplicity of pneumatically actuated fastener driving tools to a high degree of safety and sophistication, of which the tool taught in U.S. Pat. No. 3,964,659 is exemplary.

More recently, there has been considerable interest in electro-mechanical fastener driving tools utilizing a solenoid mechanism or a flywheel mechanism to drive the fasteners. Electro-mechanical fastener driving tools are of particular interest for home use and industrial use where a source of compressed air is not readily available. An example of such a tool is set forth in U.S. Pat. No. 4,298,072.

The fastener driving tools thus far described are of the single-blow variety, wherein the fastener is driven home by a single impact of the driver.

Prior art workers have also developed various types of multiple impact fastener driving tools, wherein the fastener is driven home by a plurality of impacts applied thereto by the driver. An example of a multiple impact tool is taught in co-pending application Ser. No. 06/627,428, filed July 3, 1984, in the name of Carl T. Becht, now U.S. Pat. No. 4,625,903, and entitled "MULTIPLE IMPACT FASTENER DRIVING TOOL". The teachings of the present invention are applicable to both basic types of fastener driving tools, and the nature of the fastener driving tool, itself, does not constitute a limitation with respect to the present invention, except as set forth in the claims.

Interchangeable magaziness for fastener driving tools are not, in and of themselves, new. Many prior art fastener driving tools were capable of having different magazines applied thereto to affect a change in fastener size, or the like. However, to make such a conversion from one magazine to another, required a number of tools and the changing of a number of parts and assemblies. In point of fact, the magazines of current prior art fastener driving tools are not easily interchanged.

One of the primary purposes of the present invention is to provide a magazine system whereby a single power unit can readily accept many different magazines, containing different types of fasteners, which can be mounted without the aid of tools or any significant mechanical skill.

The magazine system of the present invention has a number of advantages. As indicated above, the system can be used in conjunction with multiple impact-type fastener driving tools and with single impact-type fastener driving tools. A number of different types of fasteners can be driven by a single fastener driving tool, by simply manually detaching one magazine (containing one type of fastener) from the tool and manually mounting another magazine (containing another type of fastener) in its place. Each magazine carries its own driver, which can be easily interfaced with the driver operating mechanism of the fastener driving tool and which is appropriate for the particular type of fastener contained within the magazine. Because of the simplicity of the magazine structure and the manner in which it is mounted to the fastener driving tool, the system can utilize single-use, disposable magazines or magazines designed to be reloaded and reused.

In a single-blow fastener driving tool, the magazine should be rigidly affixable to the tool. In a multiple-blow tool, the magazine must be shiftable with respect to the tool housing to accommodate for the constant length of the driver and the diminishing length of that portion of the fastener remaining to be driven into the workpiece, during the driving operation. To meet these requirements, the present invention contemplates four embodiments of the magazine system. In a first embodiment, a plurality of different magazines containing different types of fasteners are mountable directly to the housing of a multiple-blow tool in guided, sliding relationship to the housing. In a second embodiment, the housing of a multiple-blow tool is provided with a carrier capable of easily mounting interchangeable magazines containing different types of fasteners. The carrier, itself, is mounted in the tool housing in guided, sliding relationship thereto. In a third embodiment, interchangeable magazines containing different types of fasteners are manually mountable to the housing of a single-blow tool in fixed relationship thereto. In a fourth embodiment, a single-blow tool is provided with a carrier fixedly mounted to the tool housing (or constituting an integral part thereof) to which different magazines containing different types of fasteners can be manually and interchangeably mounted.

The magazines of the system of the present invention incorporate means to feed a plurality of fasteners successively into a position to be driven, means to guide the forwardmost fastener as it is being driven, and a fastener driving means. These feeding, guiding and driving means will vary in nature, depending upon the type of fastener contained within the magazine and do not constitute a part of the present invention. The fastener driving tool is provided with means by which the magazine driver can be associated with and disassociated from the driver operating mechanism of the tool. Again, this means does not constitute a part of the present invention.

DISCLOSURE OF THE INVENTION

According to the invention, there is provided a manually attachable and detachable, interchangeable magazine system for use with fastener driving tools. The magazine system is applicable to fastener driving tools of the type having a driver operating mechanism for driving a fastener by multiple blows and to fastener driving tools of the type having a driver operating mechanism for driving a fastener in a single blow.

Each magazine contains a plurality of fasteners and a driver therefor. Each magazine is attachable and detachable by hand to either the housing of the tool or a carrier within the tool housing.

In the instance of a multiple-blow tool, the magazine is shiftable with respect to the tool housing between normal extended position and a retracted position within the housing. In one embodiment of the present invention, the magazine is mounted directly on the housing in guided, sliding relationship thereto. In a second embodiment of the invention, the magazine is detachably affixed to a carrier mounted within the tool housing in guided, sliding relationship thereto.

In the instance of a single-blow tool, the magazine is fixed with respect to the tool housing. In a third embodiment of the present invention, the magazine is detachably affixed directly to the tool housing and is fixed with respect thereto. In a fourth embodiment of the present invention, the magazine is detachably affixed to a carrier which, in turn, is fixed with respect to the tool housing and which may constitute an integral part thereof.

The magazines can be refillable and reusable magazines, or they can be single-use, disposable magazines. Magazines containing different types of fasteners are fully interchangeable within the system.

BRIEF DESCRIPTION OF THE DRAWINGS

FIG. 13 is a fragmentary, elevational view, partly in cross-section, illustrating a magazine of the type shown in FIG. 2 fixedly mounted in the housing of a single-blow fastener driving tool.

DETAILED DESCRIPTION OF THE INVENTION

While not intended to be so limited, as will be apparent hereinafter, the magazine system of the present invention will first be described in its application to a multiple-blow fastener driving tool. An exemplary tool of this general type is set forth in the above-mentioned co-pending application, the teachings of which are incorporated herein by reference, in toto. Briefly, a fastener driving tool of this type drives the fasteners into a workpiece by means of multiple impact blows applied to each fastener successively. The tool comprises a housing with a handle portion and a magazine. The magazine is shiftable in directions parallel to the long axis of the driver between a normal extended position substantially outside the housing of the tool and a retracted position substantially within the tool housing. Means are provided to bias the magazine to its normal extended position.

A prime mover provides a rotating shaft, which is operatively connected to a mechanism for translating rotary motion into reciprocating motion. The translating mechanism comprises a flywheel, an impact member, an energy transfer member separate from but engageable with the impact member, and a resilient bumper to arrest the energy transfer member at the termination of its drive cycle. The impact member has at least one impacting surface thereon and is attached to the flywheel, or constitutes an integral one-piece part thereof. The fastener driver is engageable by the energy transfer member.

A resilient member in the form of a rubber-like structure or a spring normally biases the energy transfer member out of contact with the impact member. When the tool is abutted against a workpiece and pressure is applied by the operator, this resilient member is overcome and the at least one impacting surface of the impact member transmits blows to the energy transfer member, causing the energy transfer member and the driver associated therewith to be forcibly accelerated away from the impact member at a substantial velocity. This results in the driver applying short, high-velocity drive strokes in rapid succession to the fastener being driven.

While not so limited, a fastener driving tool of the type just described lends itsellf well to the consumer market for home use and the like. This is true because, as compared to the usual single-blow fastener driving tool, the multiple-blow tool can employ a lower power prime mover, is incapable of inadvertently firing a fastener over a considerable distance with substantial force, and is characterized by being quieter, less complex, more compact and of lighter weight construction. Such a multiple-blow tool, in conjunction with the magazine system of the present invention, is even more desirable as a consumer product since it is vastly more versatile. The consumer, with a single fastener driving tool, can drive a plurality of different types of fasteners by simply interchanging magazines which can be refillable (and reusable) or disposable.

Figure 1:
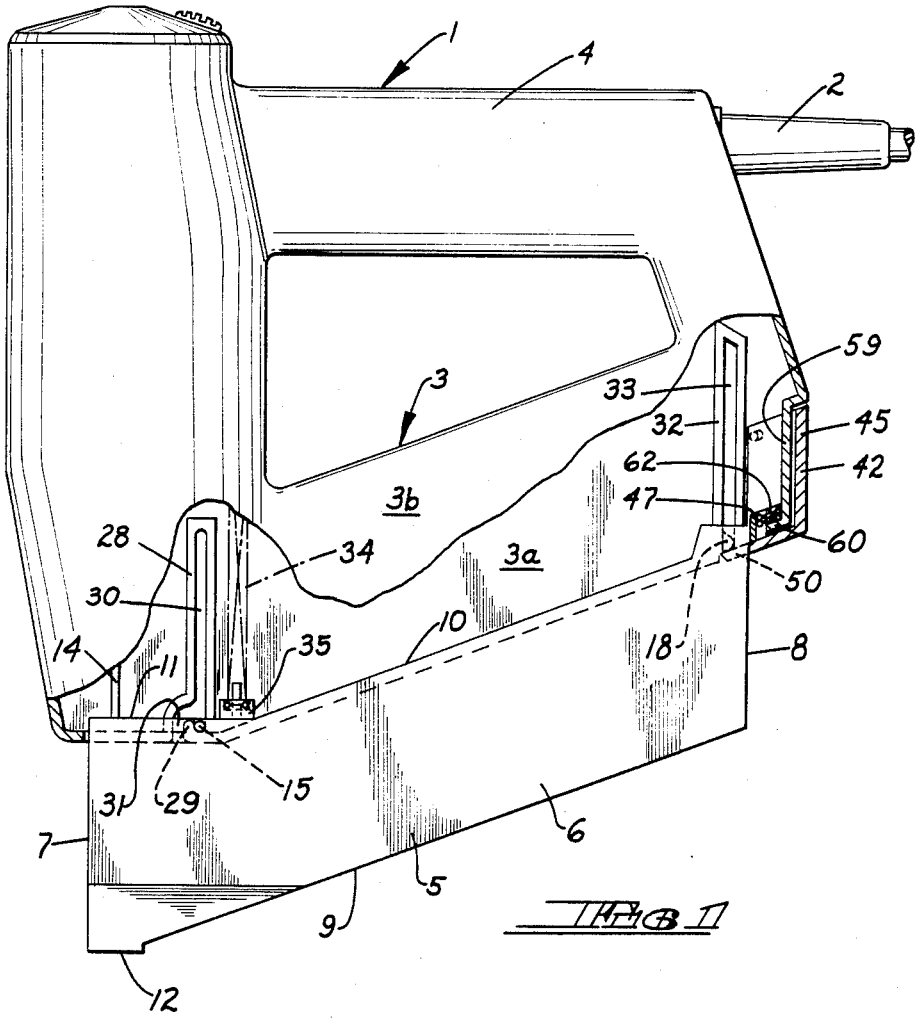
FIG. 1 is a fragmentary, side elevational view, partly in cross-section, and illustrating an exemplary multiple-blow tool with a magazine of the present invention removably attached directly to the tool housing and shiftable within the tool housing.

An exemplary multiple-blow tool is illustrated in FIG. 1. The driver operating mechanism is not shown in FIG. 1 since the nature of the driver operating mechanism does not constitute a limitation on the present invention. The tool 1 may be provided with any appropriate type of prime mover (not shown), such as an electric motor, an internal combustion motor, a hydraulic or pneumatic motor, or the like. For purposes of an illustration, the tool of FIG. 1 may be considered to have a primer mover in the form of an electric motor, connectable to a source of electrical energy by means of a conventional cord set 2. The tool 1 has a housing 3 made up of two abutting halves 3*a* and 3*b*. The housing 3 has a handle portion 4.

Figure 2:
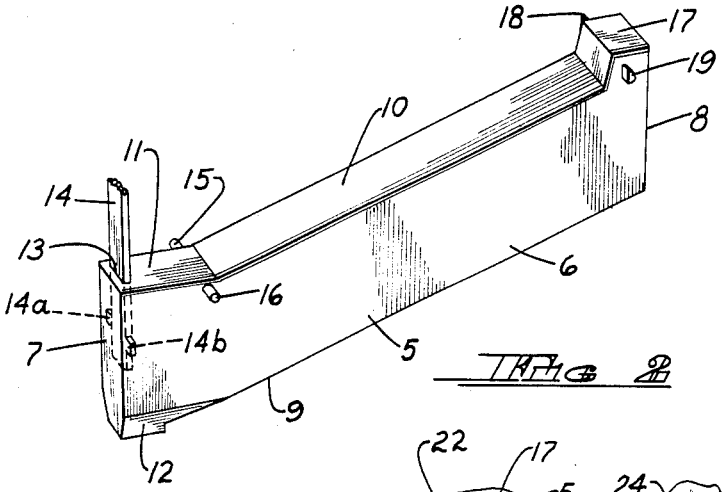
FIG. 2 is a perspective view of the magazine of FIG. 1.

A magazine 5 is shiftably mounted directly to housing 3 in a manner to be described. Reference is made to FIGS. 1 and 2. The magazine 5 comprises an elongated hollow member containing a plurality of fasteners (not shown). The magazine 5 is made up of a pair of side walls, one of which is shown at 6, a front wall 7, and a rear wall 8. The magazine 5 has a bottom 9 which slopes downwardly and forwardly, together with a top 10 which is substantially parallel to the bottom 5, except for a forward portion 11 which is substantially horizontal when the tool is held in an upright position as shown in FIG. 1. The forwardmost end of bottom 9 terminates in a nose portion 12 which is adapted to contact and abut the workpiece into which one or more fasteners are to be driven. The nose portion 12 is substantially parallel to the forwardmost top portion 11. The nose portion 12 will have a perforation (not shown) therein through which the fasteners are driven. The forward top portion 11 has a perforation or slot 13 therein through which a driver extends. The driver is fragmentarily shown at 14 in FIGS. 1 and 2. The driver constitutes a part of magazine 5, is captively mounted therein by lateral legs 14*a* and 14*b*, and is capable of shifting in both directions parallel to its long axis. The nature of driver 14 will depend, of course, on the type of fasteners contained within magazine 5, which it is intended to drive.

The magazine 5 will be provided with suitable means (not shown), as is well known in the art, to urge and advance the supply of fasteners toward the forward end 7 of the magazine so that when driver 14 is in its retracted position, the forwardmost fastener will be located thereunder in position to be driven thereby. The forwardmost portion of magazine 5, including the nose portion 12 and that portion in which the driver is reciprocally mounted, is equivalent to and serves the same purpose as the conventional guide body of a typical prior art fastener driving tool, guiding both the fastener being driven and the driver. It will be understood that the type of fastener contained within magazine 5, the nature of the means constantly urging the supply of fasteners forwardly within the magazine, and the configuration of driver 14 do not constitute parts of the present invention.

A pair of lugs or pins 15 and 16 extend transversely from the sides of magazine 5 near the top portion 11. Pins 15 and 16 are preferably of circular cross-section and are coaxial. The purpose of pins 15 and 16 will be described hereinafter.

Figure 3:
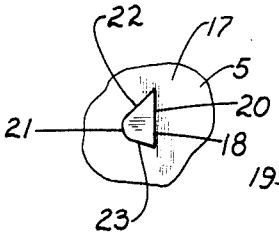
FIGS. 3 and 4 are fragmentary, elevational views of the magazine rear lugs.
Figure 4:
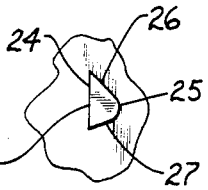

At its rearward end, the magazine 5 is provided with an upward extension 17. A pair of lateral lugs 18 and 19 are mounted on extension 17, directly opposite each other. The lug 18 is best shown in FIG. 3 and comprises a flat forward face 20, which is substantially vertical, as viewed in FIGS. 1–3. The lug 18 has an arcuate rearward surface 21 terminating in an upwardly and forwardly directed surface 22 and a downwardly and forwardly directed surface 23. The lug 19 is identical to lug 18 having a flat, substantially vertical forward face 24, an arcuate rearward surface 25, an upwardly and forwardly extending surface 26, and a downwardly and forwardly extending surface 27. The purpose of lugs 18 and 19 will be apparent hereinafter.

Reference is again made to FIG. 1. Near its forward end, the inside surface of housing half 3*a* has a flange 28 formed thereon, together with another short flange 29. The flanges 28 and 29 define a rectilinear guide channel 30 substantially parallel to driver 14. The flanges 28 and 29 also define a short lateral channel 31 beginning at the bottom edge of housing half 3*a* and connecting with channel 30 near its lowermost end, as viewed in FIG. 1. The guide channels 30 and 31 are adapted to just nicely receive pin 15 of magazine 5. It will be understood that the housing half 3*b* will be provided with flanges (not shown) on its interior surface constituting a mirror image of flanges 28 and 29 and defining guide channels equivalent to channels 30 and 31 for the receipt of pin 16 of magazine 5.

Near its rearward end, the housing half 3*a* is provided with another flange 32 defining a rectilinear guide channel 33 substantially parallel to guide channel 30 and extending from the lowermost edge of housing half 3*a*. The guide channel 33 is adapted to just nicely receive the magazine lug 18. Again, housing half 3*b* will be provided with a flange constituting a mirror image of flange 32 and defining a guide channel equivalent to guide channel 33 for the receipt of magazine lug 19.

It will be apparent to one skilled in the art that when magazine pin 15 and magazine lug 18 are located in guide channels 30 and 33, respectively, in housing half 3*a*, and when magazine pin 16 and magazine lug 19 are mounted in guide channels equivalent to guide channels 30 and 33 in housing half 3*b*, the magazine 5 will be shiftably mounted on housing 3. The guide channels 30 and 33, and their counterparts in housing half 3*b*, guide the movement of magazine 5. Magazine 5 is shiftable between a normal extended position illustrated in FIG. 1 and a fully retracted position within housing 3, determined by the abutment of pins 15 and 16 and lugs 18 and 19 with the upper ends (as viewed in FIG. 1) of their respective guide channels in housing halves 3*a* and 3*b*. Alternatively, the fully retracted position of the magazine 5 could be determined by abutment of the magazine, itself, with stop surfaces appropriately located within the housing 3. This shifting of magazine 5 accommodates for the fact that, during the driving process, the length of driver 14 remains constant, but the length of that portion of the fastener above the workpiece (into which it is being driven) diminishes as the fastener is driven.

Figure 5:
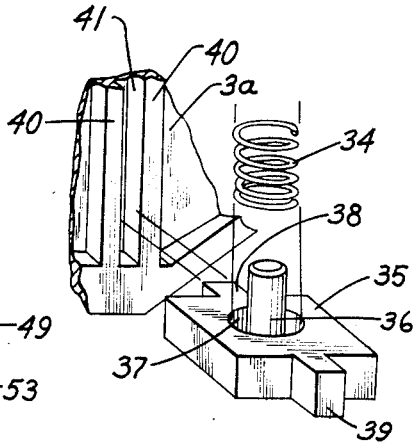
FIG. 5 is a fragmentary, exploded view of the spring and spring guide which biases the magazine to its normal extended position illustrated in FIG. 1.

The magazine 5 is biased to its normal, extended position (as shown in FIG. 1) by a compression spring 34. The upper end of compression spring 34 is appropriately anchored within housing 3. The lower end of compression spring 34 is anchored on a spring guide 35 which abuts the top portion 11 of magazine 5, enabling the spring 34 to constantly urge the magazine 5 to its extended position. Reference is made to FIG. 5, wherein compression spring 34 and spring guide 35 are more clearly shown. The spring guide 35 comprises a block-like body having an upstanding peg 36 formed on its upper surface. The peg-like member 36 is surrounded by an annular groove 37. The adjacent end of spring 34 is adapted to surround peg 36 and enter annular groove 37. Spring guide 35 is provided with a pair of opposed ears 38 and 39. As is shown in FIG. 5, the inside surface of housing half 3*a* is provided with a flange 40 which defines a guide channel 41 for the spring guide ear 38. It will be understood that the inside surface of housing half 3*b* will be provided with a similar flange (not shown) defining a similar guide channel (not shown) for spring guide ear 39. As indicated above, the spring guide 35 is adapted to abut the top portion 11 of magazine 5, enabling spring 34 to constantly urge magazine 5 to its normal, extended position. During a driving operation, as the magazine 5 shifts upwardly into housing 3

(as viewed in FIG. 1) spring 34 will be compressed and directed by spring guide 35 riding in its pair of guide channels, one of which is shown at 41 in FIG. 5.

Figure 6:
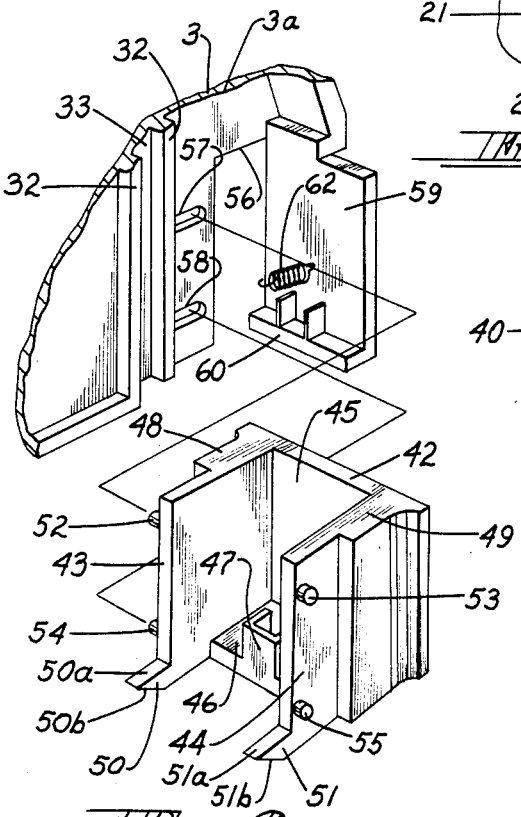
FIG. 6 is a fragmentary, exploded view of the magazine latch of FIG. 1.

To complete the structure of the first embodiment of the present invention, a latch is mounted at the rearward end of tool 1 to lock the magazine 5 thereon. Reference is made to FIGS. 1 and 6.

The latch 42 comprises a U-shaped member having a pair of parallel legs 43 and 44 joined by a base portion 45. The legs 43 and 44 are additionally joined at their bottom ends by a web 46. The web 46 mounts an upstanding U-shaped member 47, the purpose of which will be described hereinafter.

The latch 42 is enlarged as at 48 and 49 adjacent the junctures of legs 43 and 44 with base portion 45. The enlargements 48 and 49 are configured to serve as finger grips.

At the lower forward ends of legs 43 and 44, there are latch extensions 50 and 51, respectively. The latch extension 50 has an upper latch surface 50*a* and a lower cam surface 50*b*. Similarly, latch extension 51 has an upper latch surface 51*a* and a lower camming surface 51*b*. The latch 42 is completed by the provision of an upper pair of coaxial, laterally extending pins 52 and 53 on legs 43 and 44, respectively, and a lower pair of coaxial, laterally extending pins 54 and 55 on legs 43 and 44, respectively. The purpose of pins 52 through 55 will be apparent hereinafter.

FIG. 6 also shows the inside surface of the lower rearward portion of housing half 3*a*. The housing half 3*a* is provided with a notch 56 adapted to accommodate the enlarged finger grip portion 48 of latch 42. It will be understood that housing half 3*b* will be similarly notched to accommodate the finger grip portion 49 of latch 42. Adajacent guide channel 33, the inside surface of housing half 3*a* is provided with a pair of slots 57 and 58, adapted to receive latch pins 52 and 54, respectively, of leg 43. Again, it will be understood that housing half 3*b* will be provided with similar slots (not shown) to accommodate latch pins 53 and 55 of latch leg 44.

Finally, housing half 3*a* supports a downwardly depending plate 59 which constitutes an integral, one-piece portion of housing half 3*a*. As is most apparent from FIG. 1, it will be noted that plate 59 is slightly inset forwardly, to accommodate for the base portion 45 of latch 42. At its lower end, plate 59 has a in-turned flange 60 supporting a pair of upstanding walls 61 and 61*a*, spaced to receive U-shaped member 47 therebetween.

When housing halves 3*a* and 3*b* are assembled, the latch legs 43 and 44 srtraddle plate 59 and their forward portions are located within housing halves 3*a* and 3*b*. Pins 52 and 54 on latch leg 43 are located in slots 57 and 58 of housing half 3*a*. Similarly, pins 53 and 55 are located in equivalent slots (not shown) in housing half 3*b*. In this manner, the latch is shiftable forwardly and rearwardly, with respect to housing 3.

A compression spring 62 is provided (see FIGS. 1 and 6). The compression spring is held captive between the latch U-shaped member 47 and the plate 59. As a result, compression spring 62 constantly urges the latch 42 to its forwardmost position with respect to housing 3, as illustrated in FIG. 1.

Figure 7:
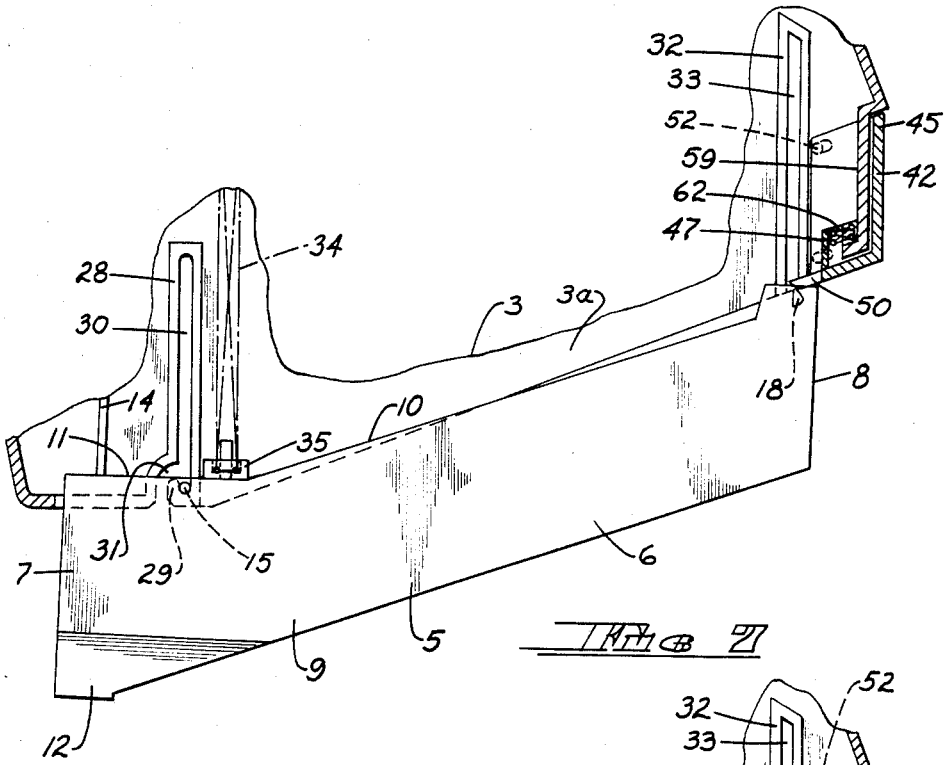
FIGS. 7 and 8 are fragmentary, elevational views, partly in cross-section, illustrating the manner in which the magazine is mounted in the housing.
Figure 8:
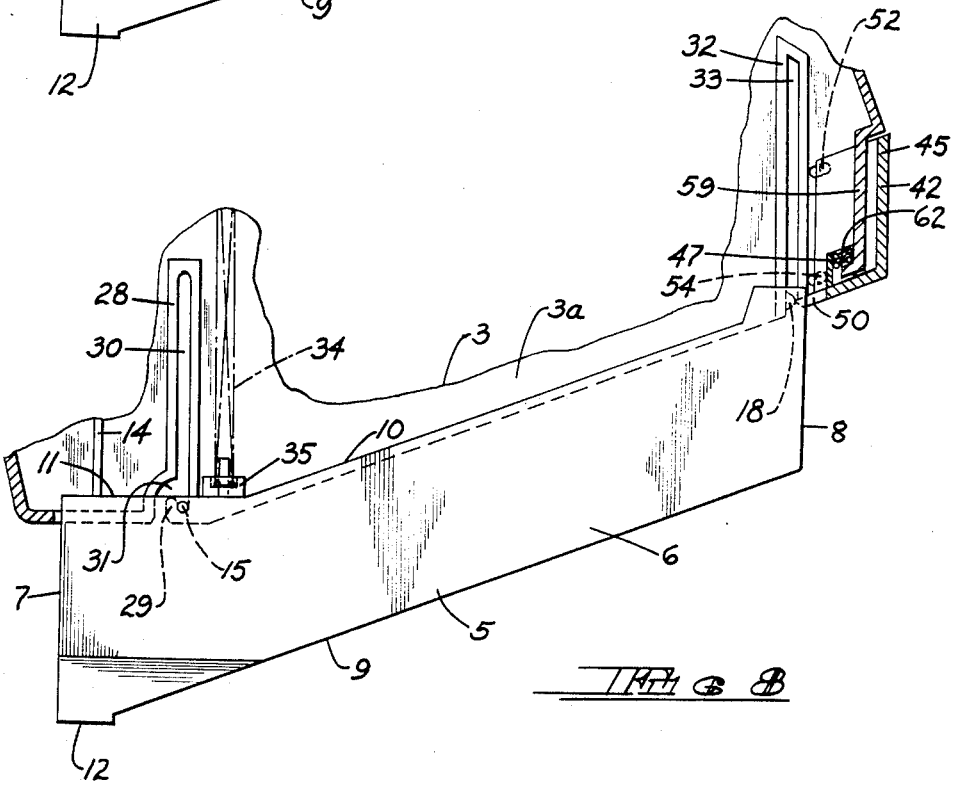

FIGS. 7 and 8 illustrate the manner in which the magazine 5 is quickly and easily affixed to tool housing 3. Turning first to FIG. 7, the magazine 5 is tilted slightly with respect to housing 3 so that the forward end of the magazine first approaches the housing. Magazine pin 15 is caused to enter lateral channel 31 in housing half 3*a*, and magazine pin 16 is caused to enter the corresponding lateral channel (not shown) in housing half 3*b*. The magazine is shifted slightly upwardly and rearwardly (as viewed in the Figures), causing magazine pin 15 to pass through lateral channel 31 into guide channel 30, the magazine pin 16 passing through its respective lateral channel equivalent to channel 31 (not shown) and into its respective guide channel (not shown) in housing half 3*b* equivalent to channel 30. At this point, the position of the magazine is as shown in FIG. 7.

Thereafter, the operator of the tool need only pivot the rearward end of magazine 5 upwardly about magazine pins 15 and 16. This will cause the upper surfaces 22 and 26 of magazine rear lugs 18 and 19 to engage the cam surfaces 50*b* and 51*b*, respectively, of latch 42. This engagement will cause the latch to shift rearwardly against the action of compression spring 62, enabling magazine lug 18 to enter its guide channel 33 in housing half 3*a* and lug 19 to enter its equivalent guide channel (not shown) in body half 3*b*. FIG. 8 illustrates latch 42 being cammed rearwardly by magazine lug 18 and magazine lug 19 (not shown).

Once magazine lug 18 has entered its guide channel 33 and magazine lug 19 has entered its equivalent guide channel (not shown), the magazine lugs 18 and 19 will be above latch extensions 50 and 51 of latch 42, enabling compression spring 62 to return the latch to its normal, forward position. In this normal, forward position, the latch surfaces 50*a* and 51*a* of latch extensions 50 and 51 will engage the lower surfaces 23 and 27 of magazine lugs 18 and 19, locking the magazine to the tool housing 3. This having been accomplished, the tool is ready for use.

To remove magazine 5 from tool housing 3, it is only necessary for the operator to grasp the finger grip portions 48 and 49 of latch 42 and pull the latch rearwardly with respect to housing 3, against the action of compression spring 62. As a result of this, the magazine lugs 18 and 19 will no longer be blocked by the latching surfaces 50*a* and 51*a* of latch extensions 50 and 51 and can be removed from their respective guide channels. Once magazine lugs 18 and 19 have been released from housing 3, the forward end of magazine 5 can be shifted slightly upwardly, forwardly and then downwardly to cause magazine pin 15 to exit from guide channel 30 into lateral channel 31 and thence out of engagement with housing half 3*a*. The magazine pin 16 will similarly shift along and out of its equivalent channels (not shown) in housing half 3*b* and the magazine is then completely detached from tool housing 3. If the magazine 5 is empty and disposable, a new magazine may be attached to the tool. Alternatively, the magazine 5 may be replaced by another similarly configured magazine containing a different type of fastener. If the magazine is refillable, it can be refilled while remaining mounted on the tool 1.

A second embodiment of the present invention is illustrated in FIGS. 9–12. Attention is first directed to FIG. 9. The embodiment of FIG. 9 differs from that of FIG. 1 primarily in that a guided, shiftable carrier is mounted in the tool housing and the magazine is manually attachable and detachable with respect to the carrier.

The overall tool is again indicated generally at 1 and differs from the tool of FIG. 1 only in a few respects, as will be set forth hereinafter. The tool again comprises a housing 3 made up of two cooperating halves, one of which is fragmentarily shown at 3a. A first difference between the tools of FIGS. 1 and 9 lies in the fact that the embodiment of FIG. 9 does not require a latch equivalent to latch 42 of FIG. 1. A second difference lies in the fact that the inside surface of housing half 3a is provided with a flange 63 defining a guide channel 64. The guide channel 64 is similar to guide channel 30 of FIG. 1 with the exception that there is no lateral channel equivalent to channel 31 of FIG. 1. The inside surface of housing half 3a, near its rearward end, is provided with a flange 65 defining a guide channel 66. The guide channel 66 is substantially equivalent to guide channel 33 of FIG. 1, differing only in that its bottom end (as viewed in FIG. 9) is closed (i.e., is not open at the bottom edge of tool housing half 3a). It will be understood by one skilled in the art that the other tool housing half (not shown) will be provided with flanges corresponding to flanges 63 and 65, defining guide channels corresponding to guide channels 64 and 66.

Figure 10:
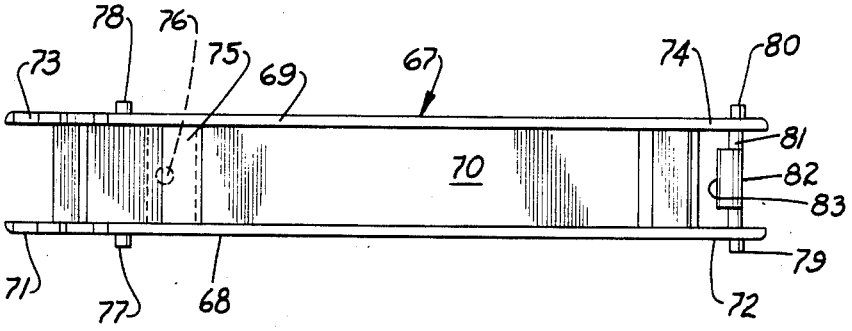
FIG. 10 is a bottom view of the carrier of FIG. 9.
Figure 11:
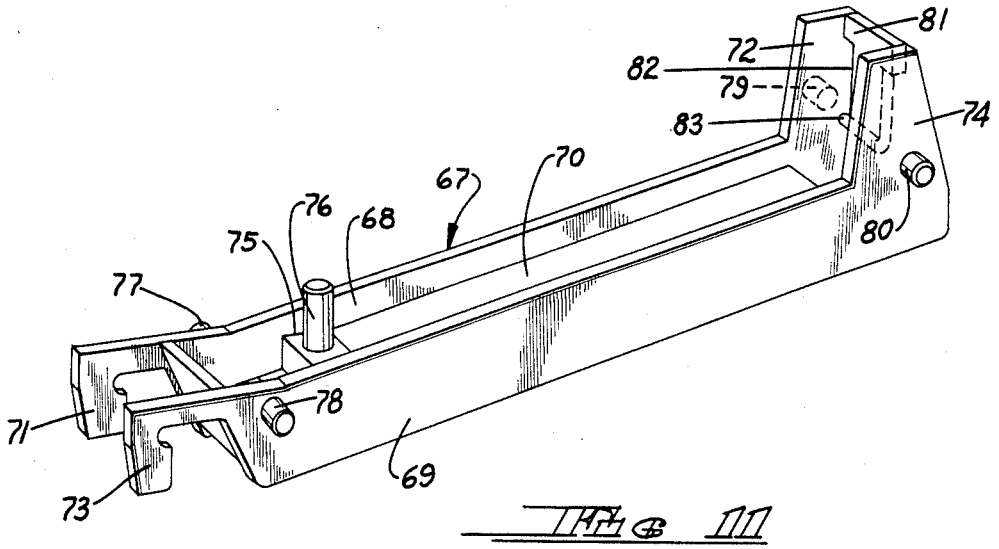
FIG. 11 is a perspective view of the carrier of FIG. 9.

The carrier is generally indicated at 67. The carrier is best shown in FIGS. 10 and 11. The carrier is made up of a pair of substantially mirror image side frames 68 and 69 joined throughout the majority of their length by a connecting web 70.

Figure 9:
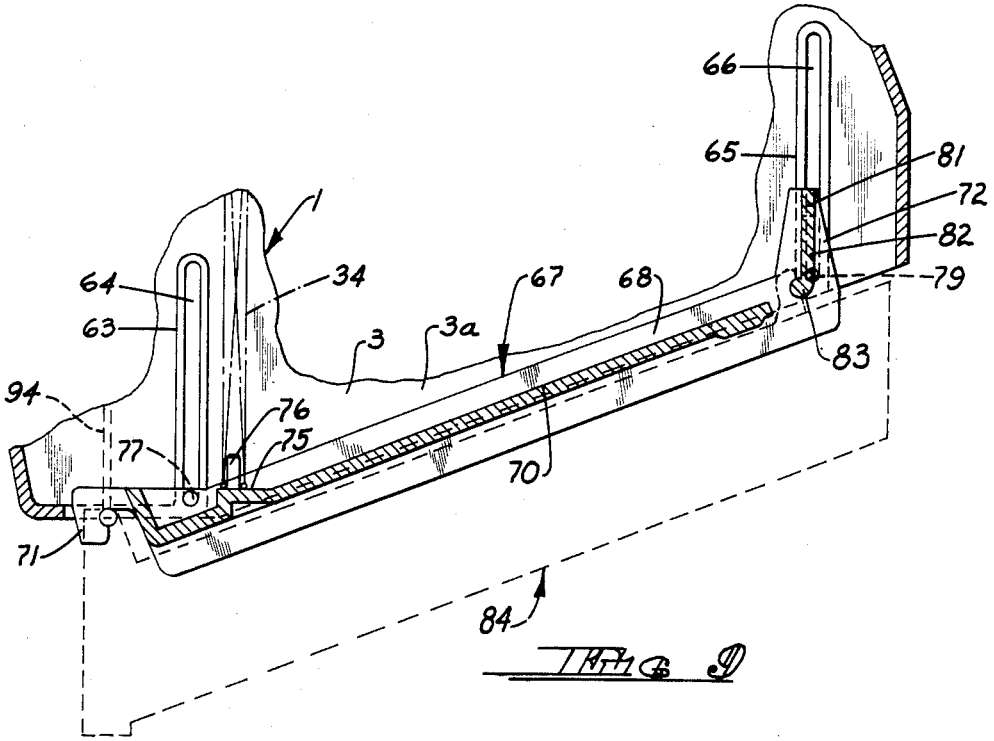
FIG. 9 is a fragmentary, elevational view, partly in cross-section and similar to FIGS. 7 and 8, illustrating a second embodiment of the present invention wherein the magazine is detachably affixed to a carrier mounted in guided, sliding relationship within the tool housing.

The majority of side frame 68 slopes downwardly and forwardly, conforming generally to the downward and forward slope of the bottom edge of housing half 3a. At its forward end, carrier side frame 68 terminates in a hook-shaped portion 71 which is angularly related to the remainder of the side frame 68 so as to be substantially horizontal when the tool 1 is held in an upright position as shown in FIG. 9. At its rearward end, the carrier side frame 68 has an upstanding portion 72. The purpose of this portion will be apparent hereinafter.

The side frame 69 of carrier 67, as indicated above, is a mirror image of side frame 68, terminating at its forward end in a hook-shaped portion 73 and at its rearward end at an upstanding portion 74. The hook-shaped portions 71 and 73 are substantially identical, as are the upstanding portions 72 and 74.

The web portion 70 of carrier 67, which joins side frames 68 and 69, extends substantially centrally of the side frames to positions just short of the upstanding members 72 and 74 at the rear of the carrier and just short of the hook-shaped portions 71 and 73 of the carrier at its forward end. Near its forward end, the web portion 70 has a portion 75 which is substantially horizontal when the tool is held in an upright position as shown in FIG. 9. The portion 75 supports an upstanding peg 76. As is clear from FIG. 9, the portion 75 and peg 76 serve as a seat for the lower end of compression spring 34. The springs 34 in FIGS. 1 and 9 are identical. However, with the provision of carrier 67, the spring guide 35 of FIG. 1 and its guiding channels in the housing halves (one of which is shown at 41 in FIG. 5) can be eliminated.

Carrier side frame 68, near hook-shaped portion 71, carries a laterally extending pin 77. Carrier side frame 69 mounts an identical pin 78, coaxial with pin 77. Similarly, the rearward upstanding portion 72 of side frame 68 supports a lateral pin shown in FIG. 11 in broken lines at 79. The upstanding rearward end 74 of side frame 69 mounts an identical, coaxial pin 80.

When the tool housing halves are assembled, the carrier 67 is located therebetween with its forward pin 77 located in guide channel 64 in housing half 3a and its rearward pin 79 located in guide channel 66 of housing half 3a. It will be understood that carrier pins 78 and 80 will similarly be located in corresponding guide channels (not shown) in the other body half of the tool (not shown). The engagement of the carrier pins 77–80 in their respective guide channels within the tool body halves serves a number of purposes. First of all, the carrier is captively held within tool housing 3. Secondly, the carrier is shiftable with respect to tool housing 3 between a normal extended position illustrated in FIG. 9 and a retracted position within housing 3 determined by the abutment of pins 77–80 with the upper ends of their respective guide channels or by abutment of the carrier, itself, with appropriate stop surfaces in the housing 3. Furthermore, each of pins 77–80 cooperates with its respective guide channel to control and guide the shifting of the carrier between its normal extended and its retracted positions. The carrier 67 is biased to its normal extended position shown in FIG. 9 by compression spring 34, in the same way that magazine 5 is so biased by compression spring 34 in FIG. 1.

To complete carrier 67, the upper ends of the rearward upstanding side frame portions 72 and 74 are joined by a transverse web 81. Depending from web 81, centrally thereof, is a resilient latch member 82 terminating at its lower edge in a bulbous latching surface 83. The purpose of latch member 82 will be described hereinafter.

The carrier 67 may be made of any appropriate material, such as metal or the like. It lends itself well, however, to be molded of plastic as an integral one-piece structure.

Figure 12:
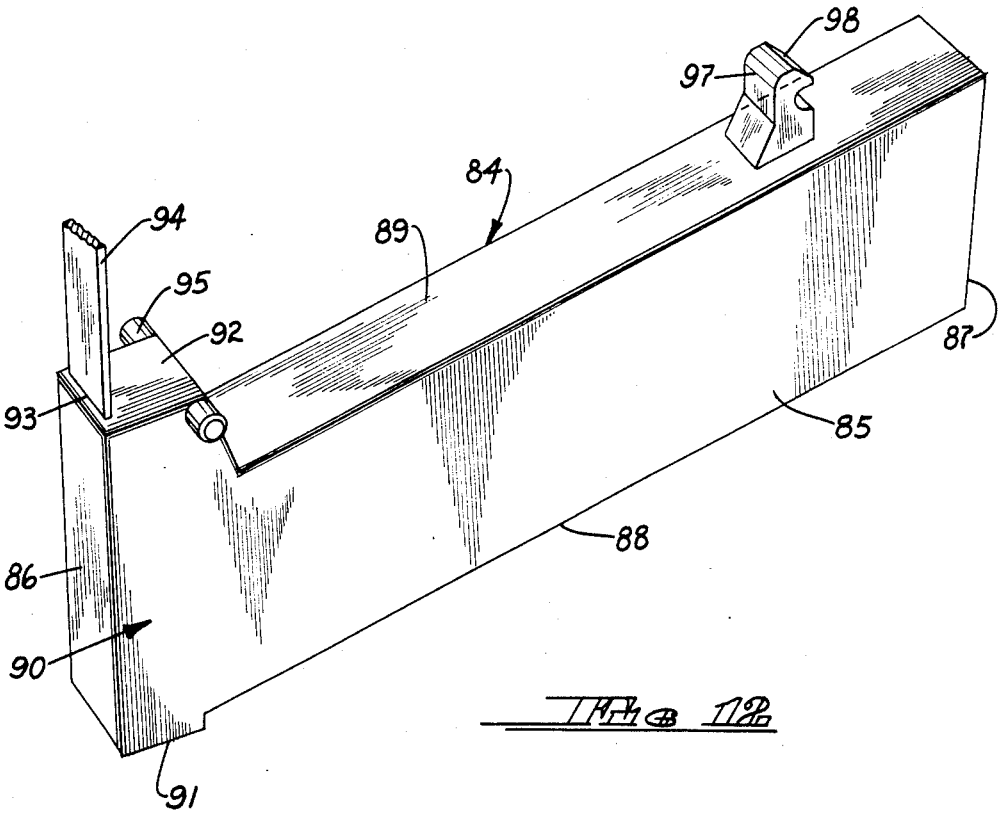
FIG. 12 is a perspective view of the magazine of FIG. 9.
Figure 1B:
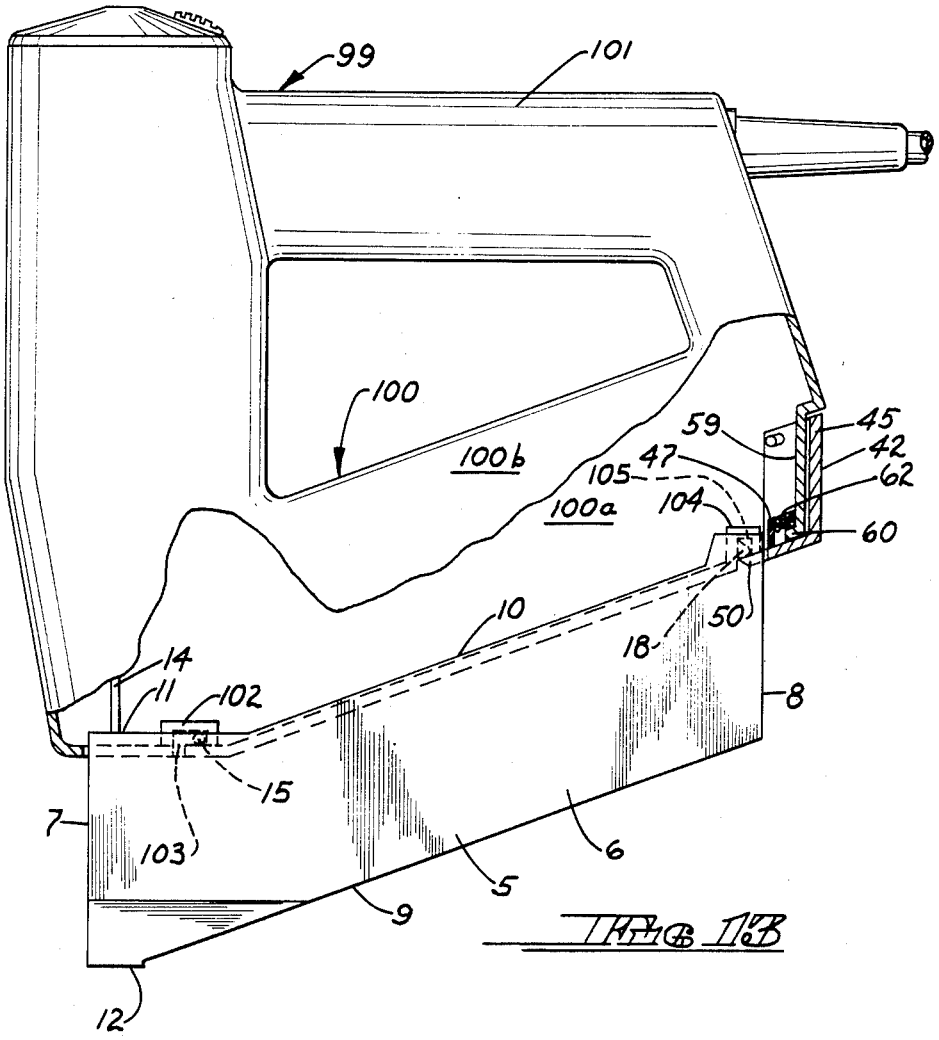

An exemplary magazine to be used with the carrier of FIGS. 9–11 is illustrated in FIG. 12 (and FIG. 9 in broken lines) and is generally indicated at 84. The magazine 84 comprises a pair of sides, one of which is shown at 85, a front wall 86, a rear wall 87, a bottom 88 and a top 89. As is evident from FIG. 9, when the tool is held in an upright position, the front wall 86 and rear wall 87 are substantially vertical, while the bottom 88 and top 89 of the magazine are substantially parallel and slope downwardly and forwardly with respect to the tool 1.

The forwardmost portion of the magazine, generally indicated at 90, is enlarged both upwardly and downwardly. This forwardmost portion 90 terminates in a bottom surface 91 which is substantially horizontal when the tool is held in an upright position as shown in FIG. 9 and which constitutes the workpiece contacting nose of the tool. At its upper end, the forward portion 90 terminates in a top surface 92, substantially parallel to the bottom surface 91. The top surface 92 is provided with an opening or slot 93 through which the driver 94 extends. Adjacent the rearward end of the top surface 92, the magazine 84 is provided with a pair of coaxial, laterally extending pins 95 and 96. To complete the structure, the top surface 89, near the rearward end of the magazine, is provided with an upstanding hook-shaped lug 97. The lug 97, in turn, is provided with a camming surface 98.

As in the case of the magazine 5 of FIG. 2, the forward portion 90 of magazine 84 captively mounts driver 94 for reciprocating movement. In addition, the forward portion 90 constitutes the guide body of the tool 1, guiding both the driver 94 and a fastener being driven thereby. The surface 91 will have an opening (not shown) therein through which the fastener being driven passes. Furthermore, as in the case of the magazine 5 of FIG. 2, the magazine 84 will contain a plurality of fasteners, together with means to advance the fasteners forwardly within the magazine 84 so that a forwardmost one of the fasteners will always be urged to a position to be driven by driver 94. The nature of the fasteners contained within magazine 84, as well as the nature of the driver and the nature of the fastener urging means, does not constitute a part of the present invention. The magazine 84, as is the case with the magazine 5 of FIG. 2, can be refillable and reusable, or it can be a single-use, disposable structure.

The carrier 67 and magazine 84 having been described in detail, their mode of operation will now be described. The forward portion 90 of the magazine is caused to approach the hook-shaped portions 71 and 73 of the carrier 67, and the magazine pins 95 and 96 are engaged in the hook-shaped carrier portions 71 and 73, respectively. The rearward end of magazine 84 is thereafter pivoted about magazine pins 95 and 96 toward the carrier until the cam surface 98 on the hook-shaped magazine lug 97 engages the bulbous latch surface 83 of the carrier latch member 82. The cam surface 98 will cause the latch member 82 to shift rearwardly until the bulbous latch surface 83 can engage the hook-shaped portion of magazine lug 97 with a snap fit. This having been accomplished, the tool is ready for use. As a fastener is being driven into a workpiece, the magazine will shift from an extended position shown in FIG. 9 to a retracted position within the tool housing 3, as determined and guided by carrier 67. At the end of a driving cycle, the tool 1 is raised from the workpiece and the carrier 67, together with magazine 84, will be returned to their normal extended positions under the influence of compression spring 34.

To remove the magazine 84 from carrier 67, it is only necessary to pull downwardly on the rearward end of the magazine until the hook-shaped lug 97 of the magazine 84 is disengaged from the bulbous latch surface 83 of the carrier latch member 82. At this stage, the carrier pins 95 and 96 can be released from the hook-shaped members 71 and 73 of carrier 67 and the magazine 84 is then free of tool 1. The magazine 84 can be replaced with another similar magazine containing a different type of fastener. If disposable and empty, the magazine 84 can be disposed of and replaced by another identical magazine. If refillable, the magazine 84 can be refilled without being removed from tool 1.

In the description thus far set forth, the fastener driving tool 1 has been described as being of the multiple-blow type. The magazine system of the present invention is equally applicable to a tool of the single-blow type, as will now be described.

Reference is made to FIG. 13, wherein a single-blow tool is generally indicated at 99. The nature of the driver operating mechanism within tool 99 does not constitute a part of the present invention or a limitation thereon. The tool 99 has a housing 100 having a handle portion 101. The housing 100 is made up of a two cooperating halves **100*a* and 100*b*. The housing 100 is shown supporting a magazine identical to that shown in FIG. 2. Since the magazine of FIG. 13 is identical to that of FIG. 2**, like parts of the magazine have been given like index numerals.

The primary difference between the tool 99 of FIG. 13 and the tool 1 of FIG. 1, insofar as the present invention is concerned, lies in the fact that the tool drives each fastener home with a single blow of driver 14. As a result, magazine 5 must be rigidly affixed to housing 100 and does not shift between normal extended and retracted positions. As a result, there is no need for a compression spring 34 and spring guide 35, as shown in FIG. 1.

The inside surface of housing half **100*a*, near the forward end thereof, is provided with a flange 102 defining an L-shaped channel 103. Near its rearward end, the inside surface of housing half 100*a* is provided with a flange 104, defining a channel 105. The channel 105 is of a length to just nicely receive magazine flange 18. It will be understood that housing half 100*b* will be provided with flanges corresponding to flanges 102 and 104, defining channels equivalent to channels 103 and 105. To complete the structure, the low rearward end of tool housing 100 is provided with a latch mechanism identical to that described with respect to FIGS. 1 and 6**, and like parts have been given like index numerals.

When it is desired to affix the magazine 5 to tool housing 100, it is only necessary to cause the forward portion of magazine 5 to approach housing 100 and to engage the magazine pins 15 and 16 in the L-shaped slot 103 of housing half **100*a* and the corresponding slot (not shown) in housing half 100*b*. When the pins 15 and 16 are fully seated within their slots, the rearward end of magazine 5 is pivoted toward tool housing 100 causing the upper surfaces 22 and 26 of magazine lugs 18 and 19 to contact the cam surfaces 50*b* and 51*b* of latch 42, shifting the latch rearwardly against the action of compression spring 62 until the magazine lugs 18 and 19 are fully seated within the channel 105 of housing half 100*a* and the corresponding channel in housing half 100*b*. At this point, the latch 42 returns to its normal position and the magazine lugs 18 and 19 are locked within their respective channels by the latching surfaces 50*a* and 51*a* of latch 42**.

To remove magazine 5 from tool housing 100, it is only necessary to pull rearwardly on latch 42, against the action of compression spring 62, to release magazine lugs 18 and 19 from their respective channels. The magazines can then be shifted slightly forwardly to release magazine pins 15 and 16 from their respective channels. The magazines can then be either disposed of or replaced by a magazine containing different types of fasteners. If refillable, the magazines can be refilled while mounted on tool 99.

The magazine-carrier system of FIGS. 9–12 can also be applied to a single-blow tool. Returning to FIG. 9, it will be apparent that if the flanges 63 and 65 on the inside surface of housing half **3*a* were so configured as to provide holes so sized as to just nicely receive carrier pins 77 and 79, rather than channels 64 and 66, and if the corresponding flanges on the inside surface of the other body half were similarly configured, the carrier 67 would be rigidly affixed between the housing halves. Under these circumstances, there would be no need for compression spring 34 or spring mount 76. It would also be within the scope of the present invention to have carrier 67 constitute an integral, one-piece part of the housing 3. For example, it could constitute a one-piece, integral part of either one of the housing halves, or both of the housing halves, if the carrier itself was made in two parts. The manner in which the magazine 84 would be attached to and removed from the stationary carier would be identical to that described above with respect to FIG. 9**.

From the description of the embodiments of the present invention, it will be apparent that a magazine system has been provided for both multiple-blow and single-blow fastener driving tools wherein a magazine can be mounted on and detached from the fastener driver without the aid of tools of any significant mechanical skill. The magazines can be refillable and replaceable, or they can be disposable, single-use magazines. A plurality of magazines, containing different types of fasteners, can be interchanged on the tool as desired, with the result that a single fastener driving tool can be used to drive a number of different types of fasteners.

As used herein and in the claims, such words as "upper", "lower", "top", "bottom", "vertical" and "horizontal", are used in conjunction with the drawings for purposes of clarity. It will be apparent to one skilled in the art that in use, the tool can be held in any appropriate orientation, and the above noted words are not intended to be limiting.

Modifications may be made in the invention without departing from the spirit of it.

What is claimed is:

1. A magazine system in combination with a fastener driving tool, said tool being of the type having a housing with a forward end, a rearward end, sides and a driver operating mechanism within said housing, said magazine system comprising a plurality of magazines each having forward and rearward ends and each containing a plurality of fasteners, the fasteners of each individual magazine being alike, characterized by said housing having an open bottom, said housing having first and second pairs of mirror image and opposed channels formed on said sides adjacent said open bottom, said first pair of channels being located near said forward end of said housing, said second pair of channels being located near said rearward end of said housing, first and second pairs of oppositely directed laterally extending coaxial lugs in association with each of said magazine of said system, said first pair of lugs being located near the forward end of said magazine and said second pair of lugs being located near said rearward end of said magazine, said first pair of lugs being engagable in said first pair of channels and said second pair of lugs being engagable in said second pair of channels facilitating manual attachment and detachment of said magazines to and from said tool, and a driver captively and reciprocally mounted in each of said magazines.

2. The magazine system and fastener driving tool claimed in claim 1 wherein said magazines are reusable and refillable.

3. The magazine system and fastener driving tool claimed in claim 1 wherein said magazines are single-use disposable magazines.

4. The magazine system and fastener driving tool claimed in claim 1 wherein said driver operating mechanism is of the type for driving a fastener into a workpiece by multiple blows, said first and second pairs of channels being configured to permit relative movement of said magazine with respect to said housing between an extended ready position wherein the majority of said magazine is located outside said housing and retracted fastener driven position wherein the majority of said magazine is located within said housing, and means to bias said magazine to said extended ready position.

5. The magazine system and fastener driving tool claimed in claim 1 wherein said driver operating mechanism is of the type for driving a fastener into a workpiece by a single blow, said first and second pairs of channels being so configured as to fixedly mount said magazine to said housing.

6. The magazine system and fastener driving tool claimed in claim 1 wherein said fasteners are chosen from the class consisting of nails, staples and clamp nails.

7. The magazine system and fastener driving tool claimed in claim 1 wherein said first and second pairs of lugs are releasably retained in said first and second pairs of channels respectively by a manually actuable latch.

8. The magazine system and fastener driving tool claimed in claim 1 wherein said first and second pairs of lugs comprise an integral part of each of said magazine.

9. The magazine system and fastener driving tool claimed in claim 8 wherein said first and second pairs of lugs are releasably retained in said first and second pairs of channels respectively by a manually actuable latch.

10. The magazine system and fastener driving tool claimed in claim 8 wherein said driver operating mechanism is of the type for driving a fastener into a workpiece by multiple blows, said first and second pairs of channels being configured to permit relative movement of said magazine with respect to said housing between an extended ready position wherein the majority of said magazine is located outside said housing and a retracted fastener driven position wherein the majority of magazine is located within said housing, and means to bias said magazine to said extended ready position.

11. The magazine system and fastener driving tool claimed in claim 10 wherein said housing comprises a pair of matable housing halves, each of said housing halves having formed on its inside surface near its forward end one of said channels of said first pair with closed ends and extending substantially parallel to the direction of said blows, together with a lateral channel leading from the lower portion of said channel of said first pair to the lower edge of said housing half, each of said housing halves having formed on its inside surface near its rearward end one of said channels of said second pair substantially parallel to said channel of said first pair and having a closed upper end and an open lower end at said lower edge of said housing half, said first pair of magazine lugs being engageable and slidable within said lateral channels and said channels of said first pair, said first pair of lugs being shiftable through said lateral channels into said channels of said first pair, said second pair of magazine lugs being engageable and slidable in said second pair of channels, said housing having latch means to close said open lower ends of said second pair of channels to releasably lock said second pair of lugs therein, said first and second pairs of channels comprising guide channels for said shiftable magazine, said means to bias said magazine to said extended position comprising a compression spring anchored at one end within said housing and mounted at its othwer end to a spring guide abuttable against said magazine, said spring guide being engaged in channels in said housing halves parallel to said first and second pairs of channels.

12. The magazine system and fastener driving tool claimed in claim 8 wherein said driver operating mechanism is of the type for driving a fastener into a workpiece by a single blow, said first and second pairs of channels being so configured as to fixedly mount said magazine to said housing.

13. The magazine system and fastener driving tool claimed in claim 12 wherein said housing comprises a pair of matable housing halves, each of said housing halves having formed on its inside surface near its forward end one of said channels of said first pair having an L-shape with one leg extending from the bottom edge of said housing half in a direction parallel to the direction of said blows and the other leg extending at substantially a right angle thereto toward the rear of said housing half, each of said housing halves having formed on its inside surface near its rearward end one of said channels of said second pair extending from the bottom edge of said housing half in a direction substantially parallel to said blows and having an open lower end and a closed upper end, said first pair of magazine lugs being engageable within said first pair of channels, said second pair of channels being so sized as to just nicely receive said second pair of magazine lugs when said first pair of magazine lugs are in said first pair of channels, said housing having latch means to close said open lower ends of said second pair of channels to lock said second pair of magazine lugs therein, whereby said magazine is rigidly affixed to said housing.

14. The magazine system and fastener driving tool claimed in claim 1 including a carrier, said first and second pairs of lugs comprise an integral part of said carrier to which each of said magazines is releasably attachable.

15. The magazine system and fastener driving tool claimed in claim 14 wherein said first and second pairs of lugs are captively and non-releasably engaged in said first and second pairs of channels respectively.

16. The magazine system and fastener driving tool claimed in claim 14 wherein said driver operating mechanism is of the type for driving a fastener into a workpiece by multiple blows, said first and second pairs of channels being configured to permit relative movement of said carrier and an attached magazine with respect to said housing between an extended ready position wherein the majority of said magazine is located outside said housing and a retracted fastener driven position wherein the majority of magazine is located within said housing, and means to bias said carrier and attached magazine to said extended ready position.

17. The magazine system and fastener driving tool claimed in claim 16 wherein said housing comprises a pair of matable housing halves, each of said housing halves having formed on its inside surface near its forward end one of said channels of said first pair with closed ends and extending substantially parallel to the direction of said blows, each of said housing halves having formed on its inside surface near its rearward end one of said channels of said second pair substantial parallel to said channel of said first pair and having closed ends, said first pair of carrier lugs being captive and slidable within said first pair of channels, said second pair of carrier lugs being captive and slidable within said second pair of channels, said first and second pairs of channels comprising guide channels for the shifting of said carrier and an attached magazine as a unit between said extended and retracted positions of said magazine, said means to bias said magazine to said extended position comprising a compression spring anchored at one of its ends within said housing and at the other of its ends to said carrier.

18. The magazine system and fastener driving tool claimed in claim 14 wherein said drive operating mechanism is of the type for driving a fastener into a workpiece by a single blow, said first and second pairs of channels being so configured as to fixedly mount said carrier and an attached magazine to said housing.

19. The magazine system and fastener driving tool claimed in claim 18 wherein said housing comprises a pair of matable body halves, each of said housing halves having formed on its inside surface a channel of said first pair near its forward end and a channel of said second pair near its rearward end, each of said channels of said first and second pairs being so sized as to just nicely receive said carrier lugs of said first and second pairs thereof respectively to rigidly affix said carrier to said housing.

* * * * *